US010982480B2

(12) United States Patent
Lygin et al.

(10) Patent No.: US 10,982,480 B2
(45) Date of Patent: Apr. 20, 2021

(54) DEVICE FOR AT LEAST PARTIALLY AUTOMATICALLY ACTUATING A DOOR LEAF

(71) Applicant: dormakaba Deutschland GmbH, Ennepetal (DE)

(72) Inventors: Konstantin Lygin, Ennepetal (DE); Sven Busch, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 230 days.

(21) Appl. No.: 16/130,075

(22) Filed: Sep. 13, 2018

(65) Prior Publication Data

US 2019/0093407 A1 Mar. 28, 2019

(30) Foreign Application Priority Data

Sep. 25, 2017 (EP) ..... 17193015

(51) Int. Cl.
*E05F 15/00* (2015.01)
*E05F 15/63* (2015.01)
(Continued)

(52) U.S. Cl.
CPC ..... *E05F 15/00* (2013.01); *E05F 1/10* (2013.01); *E05F 3/227* (2013.01); *E05F 15/53* (2015.01);
(Continued)

(58) Field of Classification Search
CPC .... E05F 15/627; E05F 2015/631; E05F 3/227
See application file for complete search history.

(56) References Cited

U.S. PATENT DOCUMENTS 5,497,533 A * 3/1996 Karlsen ..... E05F 3/00 16/71
6,848,525 B1 * 2/2005 Peterson ..... B62D 25/12 180/69.2
(Continued)

FOREIGN PATENT DOCUMENTS

CN 109555402 A 4/2019
DE 19717993 A1 * 10/1998 ..... E05F 3/22
(Continued)

OTHER PUBLICATIONS

CN Office Action dated Apr. 9, 2019 re: Application No. 2017039/CN, pp. 1-4.

*Primary Examiner* — Marcus Menezes
(74) *Attorney, Agent, or Firm* — Cantor Colburn LLP

(57) ABSTRACT

A device for at least partially automatically actuating a door leaf, includes a drive having a drive axis of rotation for driving the door leaf at least partially during a movement between an opening position and a closing position, a casing element having a casing axis of rotation for assisting a movement of the door leaf, lever kinematics having at least one lever arm for establishing an operative connection between the drive and the casing element. The lever arm includes a drive-sided connection section, which is supported to be rotationally movable around the drive axis of rotation. The lever kinematics includes at least one transmission component for transferring electric energy and/or data between at least one casing-sided energy source and a drive-sided energy recipient. The connection section has a cranked course, wherein a multi-layered functional compartment for mechanically connecting the lever arm and for electrically connecting the transmission component to the drive is configured along the cranked course of the connection section.

13 Claims, 5 Drawing Sheets

(51) Int. Cl.

| | |
|---|---|
| ***E05F 1/10*** | (2006.01) |
| ***E05F 15/627*** | (2015.01) |
| ***E05F 3/22*** | (2006.01) |
| ***E05F 15/53*** | (2015.01) |
| ***E05F 15/70*** | (2015.01) |

(52) U.S. Cl.
CPC ..... *E05F 15/627* (2015.01); *E05F 15/63* (2015.01); *E05F 15/70* (2015.01); *E05F 2015/631* (2015.01); *E05Y 2400/654* (2013.01); *E05Y 2900/132* (2013.01)

(56) References Cited

U.S. PATENT DOCUMENTS

| | | | | |
|---|---|---|---|---|
| 7,910,832 | B2 * | 3/2011 | Pieh | E05F 15/655 174/99 R |
| 2005/0095903 | A1 * | 5/2005 | Stenzel | B60R 16/0215 439/501 |
| 2017/0362874 | A1 * | 12/2017 | Worner | E05F 15/622 |
| 2019/0093407 | A1 * | 3/2019 | Lygin | E05F 15/00 |
| 2019/0242173 | A1 * | 8/2019 | Soderqvist | E05F 3/227 |

FOREIGN PATENT DOCUMENTS

| | | | | |
|---|---|---|---|---|
| DE | 19809909 | A1 * | 9/1999 | E05F 3/222 |
| DE | 10329562 | A1 * | 2/2005 | E05F 3/102 |
| DE | 102011087695 | A1 * | 6/2013 | E05F 5/08 |
| DE | 102012210590 | A1 * | 12/2013 | E05F 3/227 |
| EP | 0764752 | A2 * | 3/1997 | E05F 3/223 |
| EP | 1134350 | A2 * | 9/2001 | E05F 3/222 |
| EP | 2476849 | A2 * | 7/2012 | E05D 15/08 |
| EP | 2787156 | A2 | 10/2014 | |
| EP | 2787156 | A3 * | 10/2014 | E05F 15/63 |
| EP | 3064694 | A1 * | 9/2016 | E05F 15/63 |
| EP | 3064694 | A1 | 9/2016 | |
| WO | WO-2004106683 | A1 * | 12/2004 | E05F 15/53 |
| WO | WO-2016116526 | A1 * | 7/2016 | E05F 5/027 |
| WO | WO-2016196485 | A1 * | 12/2016 | E05F 3/22 |

* cited by examiner

DEVICE FOR AT LEAST PARTIALLY AUTOMATICALLY ACTUATING A DOOR LEAF

TECHNICAL FIELD

The following disclosure relates to a device for at least partially automatically actuating a door leaf. Furthermore, the disclosure relates to a system for at least partially automatically actuating a door leaf. Moreover, the disclosure relates to a method for mounting a corresponding device.

BACKGROUND

Basically, devices for at least partially automatically actuating a door leaf are already known. Often electric energy, in particular power is used for driving automatic or partially automatic devices. Often, at least one data connection is established between the door leaf and a door casing for monitoring and/or controlling automatic, partially automatic or purely mechanical devices. Mostly, the power and/or data are/is conducted between the door leaf and the door casing via a transmission means. The transmission means may be laid in the shape of a cable on the outside between the door leaf and the door casing. In this case, such transmission means have proven to be disadvantageous in that they often compromise the design of the door, and furthermore they are prone to the risk of damages.

SUMMARY

It is the object of the present disclosure to overcome at least in part the above-described disadvantages in a device for automatically actuating a door leaf. In particular, it is the object of the present disclosure to provide a device for at least partially automatically actuating a door leaf, which is simple and configured with a few structural components, which allows for an inexpensive and simple mounting, which presents an expanded and enhanced functionality, which delivers a high-quality appearance, and reliably protects against damages.

The above object is achieved by means of a device having the features of the independent device claim, in particular from the characterizing part, by means of a system having the features of the independent system claim, in particular from the characterizing part, as well as by means of a method having the features of the independent method claim, in particular from the characterizing part.

Further features and details of the disclosure will result from the dependent claims, the description and the drawings. In this case, features and details, described in conjunction with the inventive device and/or the inventive system, are obviously also valid in conjunction with the inventive method and respectively vice versa, such that mutual reference is made, respectively may be made with respect to the disclosure of individual aspects of the disclosure.

The disclosure provides a device for at least partially automatically actuating a door leaf, including: a drive having a drive axis of rotation for driving the door leaf at least partially during a movement between an opening position and a closing position, a casing element having a casing axis of rotation for assisting a movement of the door leaf, lever kinematics having at least one lever arm for establishing an operative connection between the drive and the casing element, wherein the lever arm includes a drive-sided connection section, which is supported to be rotationally movable around the drive axis of rotation, and wherein the lever kinematics includes at least one transmission means for transferring electric energy and/or data between at least one casing-sided energy source and a drive-sided energy recipient. Furthermore, the lever kinematics may include a casing-sided guiding section, which may be disposed to be at least rotationally movable around the casing axis of rotation. According to the disclosure, for this purpose it is intended that the connection section has a cranked course, wherein a multi-layered functional compartment for mechanically connecting the lever arm and for electrically connecting the transmission means to the drive is configured along the cranked course of the connection section.

Advantageously, in a first exemplary embodiment, the inventive lever kinematics may include at least one lever element. Furthermore in a further exemplary embodiment, it is conceivable that the lever kinematics includes two lever elements.

In the first exemplary embodiment with lever kinematics having one lever element, the latter is disposed to be rotationally movable at a casing axis of rotation of the casing element. Advantageously in this case, the casing axis of rotation may be configured in the shape of a sliding axis of rotation. For example, the casing element may be configured in the shape of a sliding element. The casing element, respectively the sliding element is disposed in a casing-sided guiding rail, in particular in a horizontal sliding rail, and guided by means of the sliding rail, preferably linearly. Advantageously, in this case the casing element may slide almost without friction in the guiding rail. In other words, the casing element is employed as a support element at the door casing, in order to at least partially assist the movement of the door leaf. Simultaneously, the lever element at the connection section performs a rotary movement around the drive axis of rotation. Thereby, the door leaf is transferable into an opening position and/or a closing position. It is conceivable that the sliding element be configured spring-loaded and guidable by a spring.

In a second exemplary embodiment with lever kinematics having two lever elements, the latter are likewise disposed at a casing axis of rotation of the casing element. Advantageously, the casing element may be disposed stationarily door casing-sided. Advantageously in this case, the casing axis of rotation is configured in the shape of a stationary connecting axis of rotation, in order to dispose the casing element to be rotationally movable at the door casing. During a transfer of the door leaf from the opening position into the closing position, a second lever arm of the lever kinematics rotates around said casing axis of rotation. Furthermore, a first lever arm of the lever kinematics is connected to the drive axis of rotation to be rotationally movable. During a transfer of the door leaf from the opening position into the closing position or vice versa, the two lever arms are connected to each other around a joint, in particular rotary joint, so that said both lever arms in the opening position of the door leaf form a larger angle with each other than in the closing position of the door leaf.

Furthermore, the lever kinematics may include a cover or be disposed in a housing. A protection of the lever kinematics may be achieved thereby, in particular from environmental influences, such as humidity, dust or UV-radiation, however also from mechanical influences.

The transmission means is employed for transferring electrical energy and/or data between the casing-sided energy source and the drive-sided energy recipient on the door leaf. In particular electrical current may be understood as the energy, wherein the energy source may be a power source. Furthermore as an alternative or in addition, data may be transferred, in particular on the condition of the door leaf. For example, such data may serve for the position detection of the door leaf or for displaying the condition of the door leaf. In this case, the opening position, the closing position or the performed movement of the door leaf may be displayed on an energy recipient, such as for example a display device. Furthermore, during an actuation of the door leaf, electrical energy may be utilized for example, in order to transfer the door leaf from the opening position into the closing position. Furthermore, likewise, the door leaf may be retained in a position, in particular the opening position and/or the closing position. Furthermore, by supplying electrical energy, the force necessary for transferring the door leaf from the opening position into the closing position may be reduced, increased or adjusted according to a predetermined pattern course. Advantageously, the transmission means may be an electrical cable, for example a multiple-wire flat ribbon cable. Thereby, preferably the transmission means is guided to be interruption-free.

In this case, the inventive idea relates to providing the lever arm with a cranked connection section. This results in that in above said connection section a preferably multi-layered functional compartment, respectively a free space having several layers is created, which will be employed for a plurality of different application possibilities. On the one hand, with the connection section at least one mounting layer is formed in the functional compartment, in which the connection section may be mounted with a lower terminal part rotationally movable around the drive axis of rotation. On the other hand, the functional compartment in a reception layer may be employed as an additional compartment, in order to be able to comfortably place and position an attachment means for the connection section at the drive during the mounting of the device. Furthermore, in a guiding layer, the functional compartment is used as a cable compartment for the trouble-free passage of the transmission means. Moreover, the functional compartment is configured such that a plug-in unit may be disposed in the guiding layer, in order to readily electrically connect the transmission means to the drive by plugging it in into the plug-in unit. Moreover, the functional compartment may accommodate a traction relief unit for the transmission means, for example in the guiding layer. Furthermore, the functional compartment, at least in the guiding layer, may be employed for twisting and/or for deflecting the transmission means, in order to provide for an improved length and/or rotation compensation for the transmission means. Advantageously in addition, the functional compartment may be configured as a coverable and/or sealable compartment, in order to accommodate the transmission means at the junction to the drive in a manner protected against mechanical interventions and/or environmental influences.

Consequently, numerous advantages may be achieved by means of the inventive device. On the one hand, the inventive device is simple and constructed with few structural components, because the functional compartment is created by the connection section of the lever arm. On the other hand, the inventive device allows for an inexpensive, simple and comfortable mounting, in which the mechanic installer is able to establish step by step a mechanical connection between the lever arm and the drive, and an electrical connection between the transmission means and the drive. For this purpose, the mechanic installer may intuitively work through the respective layers in the functional compartment from the bottom to the top, which one after the other may be functionally readily employed. Moreover, the functional compartment with its layer offers a support and positioning help for all structural components of the inventive device to be mounted, which one after the other, guided by the layers of the functional compartment, may be readily and even single-handedly mounted. Furthermore, the inventive device includes an expanded and enhanced functionality, because the different above-described functions are directly incorporated into the device, in particular into the functional compartment, and do not have to be realized later and/or from the outside of the device. Moreover, the protected and covered functional compartment allows for providing a high-quality appearance of the inventive device, and the protection of the device against manipulations may be increased.

Furthermore, the disclosure may provide for in a device that the functional compartment includes at least one of the following layers, namely:

- a guiding layer for guiding the transmission means from the lever arm to the drive,
- a reception layer for the at least partial reception of a mechanical attachment means, in order to attach the lever arm rotationally movable at the drive,
- a mounting layer for producing an interface between the lever arm and the drive.

On the one hand, the above-mentioned layers may determine an order, in which the mechanic installer may proceed when mounting the device. Thereby, the mounting may not only be executed in a simple manner but also intuitively. Each individual layer fulfils its function, and will be employed one after the other from the bottom to the top. Thus, initially the mounting layer may be employed, which may be formed by the lowermost part of the connection section. In this case, said terminal part may be directly attached to the drive axis of rotation to be rotationally movable. For this purpose, the connection section may be torque-proof attached to a rotatable bolt of the drive axis of rotation, in order to rotate with the bolt around the drive axis of rotation. The reception layer located above the mounting layer ensures a comfortable and simple reception of the attachment means. Finally, the guiding layer offers the advantage for the transmission means to be accommodated trouble-free in the functional compartment without kinking. Moreover, the functional compartment offers the possibility of orienting the transmission means accordingly, potentially to twist and/or to deflect it, so it may be connected to the drive in a kink-free manner and with rotation and/or length compensation. Furthermore, the guiding layer offers the advantage of being able to dispose therein a traction relief unit and/or a plug-in unit for the transmission means. Furthermore, it is of advantage that the multi-layered functional compartment may form a closable and/or sealable compartment, in order to protectively shield the attachment means for the lever arm and the plug-in connection for the transmission means. Thereby, not only the advantage of an enhanced high-quality visual aspect increases but also the manipulation protection of the device.

Furthermore, the disclosure may provide for in a device that the functional compartment, in particular in the guiding layer, includes an entry area into the functional compartment and an exit area from the functional compartment for the transmission means, which are configured such that the transmission means is guided transversely with regard to, respectively through the drive axis of rotation through the functional compartment. The entry area may be configured either by a recess, by a depression, by a groove or by a break-through at the lever arm at the junction to the connection section, or by a traction relief unit such that the transmission means, for example coming from the lever kinematics, may be introduced into the functional compartment. Furthermore, the exit area may be configured by a plug-in unit such that the transmission means may be guided out of the functional compartment. Furthermore, the transmission means may include a vertex in the drive axis of rotation. Preferably, the vertex is located centrally in the centre of the functional compartment on the drive axis of rotation. Thereby, the advantage may be achieved that the change in length of the transmission means during a relative rotation between the lever kinematics, on the one hand, and the drive, respectively the connection section, on the other hand, may be compensated for. As the transmission means extends through the drive axis of rotation the length of the part of the transmission means, which extends through the functional compartment, is not changed during the relative rotation of the lever kinematics and of the drive.

Furthermore, the disclosure may provide for in a device that the connection section may include a cover element, in order to at least delimit, to mechanically secure or to seal-off the functional compartment. Thus the advantage may be achieved that the inside of the device, counting sensitive electrical connections, potentially sensor technology and mechanical attachment means may be disposed to be inaccessible from the outside. Moreover, mechanical protection and sealing allow for an improved operation and increase the longevity of the device.

In addition, the disclosure may provide for in a device that the connection section at an entry area into the functional compartment includes a traction relief unit with a first connecting element and with a second connecting element, in order to positively and/or non-positively immobilize the transmission means between the first connecting element and the second connecting element. In other words, the transmission means may be retained in an immobilized position between the first connecting element and the second connecting element of the traction relief unit, in order to inhibit the transmission of a mechanical traction at the electrical connection locations towards the drive, and to prevent a release of the transmission means from the drive. In this case, it should be noted that a non-positive connection is not realized by pressing onto the transmission means, but by means of a light, preferably repeated bending of the transmission means, whereby a snap-free friction connection is realized. At the casing side, the transmission means may include a modifiable length compensation, and be linked under tension, if for example the casing element is guided in a guiding rail. However, also in a pure rotational bearing of the casing element, a tension may be present in the transmission means. Said tension may be eliminated from the transmission means at the drive side by means of the traction relief unit.

Moreover, the disclosure may provide for in a device that the traction relief unit includes a labyrinth guide between the first connecting element and the second connecting element. The labyrinth guide may achieve the advantage that the traction may be easily diverted from the transmission means to the traction relief unit. In addition, the labyrinth guide may deflect the tractive force several times, and enhance the distribution of the tractive force at the traction relief unit. Moreover, the labyrinth guide may achieve with advantage that the transmission means does not suffer any kink and/or break points.

Furthermore, the disclosure may provide for in a device that the labyrinth guide is configured such that the transmission means is guided through the labyrinth guide in a twisted manner around a first angle of torsion.

A twisting, respectively rotation of the transmission means around the longitudinal axis thereof may be understood as the torsion. The torsion is accomplished by a torsion moment, which acts upon the transmission means on the outside and vertically to the longitudinal axis thereof. Such a twisted immobilization of the transmission means in the labyrinth guide assists in achieving a rotation compensation at the transmission means, if the lever kinematics and the drive axis of rotation rotate in relation to each other. In particular with a flat ribbon cable, a rotation compensation is difficult in the plane of flat ribbon, because different angles and/or tensions need to be compensated for along the width of the flat ribbon cable. Advantageously, by means of twisting the flat ribbon cable, one strip may be created at the flat ribbon cable, which equalizes different angles and/or tensions. Advantageously, said strip at the flat ribbon cable may be employed as the rotation compensation.

Furthermore, the disclosure may provide for in a device that the transmission means includes at least one first torsion around a first angle of torsion, preferably of 90°, at an entry area into the functional compartment, or a second torsion around a second angle of torsion, preferably of 90°, at an exit area from the functional compartment. Advantageously, tensions may be intercepted and equalized with the first torsion, which tensions develop in the plane of rotation of the lever arm. Moreover, the second torsion is able to intercept and equalize tensions, which develop in the plane, which is determined by the longitudinal axis of the lever arm and the drive axis of rotation. Thereby, in a simple and advantageous manner, a reliable three-dimensional rotation compensation is created at the transmission means, even in the shape of a flat ribbon cable.

Furthermore, the disclosure may provide for in a device that the transmission means includes at least one deflection having a deflection angle, preferably of 45°, respectively a bent with a change of direction of 90°, at an exit area from the functional compartment, in order to deflect the transmission means from an orientation transversely to the drive axis of rotation of the drive into an orientation parallel to the drive axis of rotation, and to thereby achieve a change of direction of the transmission means by 90°. By deflecting the transmission means parallel to the drive axis of rotation, respectively by bending the transmission means under a change of direction by 90°, such that the transmission means is oriented parallel to the drive axis of rotation, the advantage may be achieved that the transmission means is guided underneath the connection section directly to the drive.

In addition, the disclosure may provide for in a device that the connection section at an exit area from the functional compartment includes a plug-in unit for the transmission means, in order to electrically connect the transmission means to the drive. Thus, a simple contacting of the transmission means to the drive may be created. For this purpose the mechanic installer may even single-handedly grasp the free end of the transmission means and insert it into the plug-in unit, for example as far as to an abutment.

Furthermore, the disclosure may provide for in a device that the plug-in unit be configured such that the transmission means is at least deflected around a deflection angle, preferably of 45°, or is guided through the plug-in unit in a twisted manner around a second angle of torsion. Thereby, the advantage may be achieved that the second torsion and/or deflection of the transmission means at the exit area from the functional compartment may be directly secured by means of the plug-in unit. Indirectly, the plug-in unit may provide a further traction relief for the transmission means.

Furthermore, the disclosure may provide for in a device that the plug-in unit include at least one plug-in guide, which is configured partially cylinder-envelope shaped towards the drive axis of rotation of the drive, in order to deflect the transmission means from an orientation transversely to the drive axis of rotation into an orientation parallel to the drive axis of rotation, wherein the plug-in guide includes a slot, which is oriented parallel to the drive axis of rotation, in order to introduce the transmission means into the plug-in guide in a twisted manner. Thus, a flat ribbon cable as the transmission means may be accommodated kink-free and break-free and thus in a spared manner in the plug-in unit, wherein the flat ribbon cable may be accommodated in a deflected manner in the cylinder-envelope shaped configured plug-in guide of the plug-in unit and/or accommodated in a twisted manner by means of the slot, which is oriented parallel to the drive axis of rotation. In other words, the cylinder-envelope shaped configured plug-in guide with a slot extending parallel to the drive axis of rotation may guide the flat ribbon cable to the drive with traction relief and a rotation compensation.

Moreover, within the scope of the disclosure, it is conceivable that the transmission means be configured at least section-wise as a flat cable, flat ribbon cable or as a flexible printed circuit board, and/or the transmission means be configured at least section-wise as a round cable. A flat cable, respectively a flat ribbon cable is a multiple-wire cable, in which the individual wires are guided parallel next to each other. Multiple-wire flat ribbon cables have the advantage of connecting multiple wires at once, instead of soldering them individually in an insulated manner. It is likewise conceivable that the flat cables respectively flat ribbon cables be configured with a shielding, which in particular may include aluminium or copper film. With a flexible printed circuit board, it may be a printed circuit, which in particular is built up on flexible plastic material carriers. In this case, copper may be employed as the conductor material. Moreover, likewise round cables as the transmission means are conceivable, which have a circular cross-section, and in which the individual wires are disposed in a round manner around the centre. Round cables may have the same function as flat cables, respectively flat ribbon cables. Advantageously, flat ribbon cables may be simply twisted and/or deflected, because the individual wires experience little kinking during twisting and/or deflecting the flat cable. For example, with a bending radius of approximately 5 mm, a flat ribbon cable may have a service life of at least 200,000 bending cycles, with a bending radius of approximately 8 mm it may have a service life at least 2 millions of bending cycles. With a largest possible bending radius, a mechanical stress of the transmission means is reduced, and thus the service life of the transmission means may be considerably increased.

Furthermore, within the scope of the disclosure, it may be intended in a device that the lever arm include a guiding groove for the transmission means. Thus, the transmission means may be countersunk in the lever arm. Moreover, it is conceivable that the lever arm includes a groove covering for the transmission means, in particular for the guiding groove. Thus, the transmission means may be covered, and protected against manipulations and/or environmental influences, without compromising the appearance of the device.

Furthermore, the disclosure may provide for in a device that the energy recipient be at least one of the following:

electrical motor,
hydraulic actor,
pneumatic actor,
cylinder
electro-chemical actor,
electro-mechanical actor,
piezoelectric element,
magnetic element,
shape memory element,
optical element,
acoustic element,
display element,
control unit,
transmitting/receiving unit,
sensor unit,
interlocking unit,
interface.

The preceding listing is a non-exhaustive enumeration. The electrical motors are electro-mechanical converters having a high efficiency and additionally small dimensions, which thereby are easy to install and are space-saving. Furthermore, a hydraulic actor is conceivable, which while utilizing a liquid performs an energy transfer. Advantageously, hydraulic actors likewise just require very little construction space such that a flexible adaptation to space specifications is possible. Likewise, the speed of hydraulic actors may be continuously regulated, they have a high positioning precision, and have a low noise level. Moreover, likewise pneumatic actors are conceivable, which while using compressed air perform mechanical work. Pneumatic actors are likewise continuously adjustable, insensitive to temperature variations, and allow for high operating speeds. Furthermore, pneumatic actors likewise have a low noise level. In addition, likewise a cylinder is conceivable, which may be embodied as a hollow cylinder. Furthermore, it may be a tube-shaped chamber, about which a piston may be operated, and thereby may function as a lifting column, or as a telescopic drive. Moreover, likewise pneumatic and hydraulic cylinders are conceivable, which are continuously adjustable, and function at a low noise level. Likewise conceivable are electro-chemical actors, which combine a chemical reaction with electrical energy. In this case, likewise a particularly low-noise use is guaranteed. Furthermore, a piezoelectric element is conceivable, wherein piezoelectric elements are able to perform a mechanical movement when applying electrical voltage. In particular, piezoelectric elements may be embodied with certain crystals or piezoelectric ceramics. Advantageously, by means of a relatively high voltage at high frequency a very small movement amplitude may be realized in a piezoelectric element. Furthermore, a magnetic element is conceivable, which applies a magnetic field, by means of which a body may be moved in said field. A magnetic element operates at particularly low energy as well as at a low noise level, and therefore it is particularly inexpensive and user-friendly. Moreover, likewise a shape memory alloy may be employed, wherein it is a metal, which may be transformed into different structures. By applying an impulse, in particular of energy, the shape memory element is returned into the original shape thereof. In this case, a shape memory element is usable for a particularly long period of time at a very low energy expense. Moreover, a shape memory element functions at a particularly low noise level. Likewise optical, acoustic or other display elements are conceivable, which display the current condition of the door leaf. This may be realized in particular via optical elements, in particular an LED or OLED, which visualizes a condition in particular in a certain colour code, such as for example green or red for the opening condition, respectively the closing condition. Furthermore, an illumination via an illumination unit of the door leaf is conceivable, which may illuminate the door leaf as well as the passage space. Furthermore, acoustic signals, for example during the opening or closing procedure of the door leaf are conceivable, which may in particular indicate a change in condition. Moreover, likewise display elements, such as in the shape of a display, for example lettering or symbols, may in particular indicate different conditions of the door. Furthermore, control units are conceivable, which may transfer the door leaf into different positions, in particular into the opening position or the closing position. Furthermore, it is possible the door leaf may be retained in one position, in particular in the opening position and/or the closing position by means of a control unit. Furthermore, a control unit may likewise generate a force, which reduces, increases and/or controls along a trajectory the force required for the transfer of the door leaf from the opening position into the closing position. Furthermore, likewise transmitting and/or receiving units, as well as sensor units are conceivable, which may generate data, in particular on the current condition of the door leaf. Such data may be for example data for the position detection of the door leaf, in particular whether or not the latter is located in the opening position or the closing position. Furthermore, sensor units are conceivable, which may detect the position of the door leaf, in particular the degree of the opening of the door leaf. Such data may be likewise transferred to an additional interface, which may be in connection with a data network. Furthermore, such a data network may establish a connection for example to a control centre remote from the door leaf, for example a central control centre, in which a remote diagnosis may be realized, in particular on the condition of the door leaf, and likewise the positions of the door leaf may be monitored. Furthermore, it is conceivable that such an interface of the door leaves be connected to a monitoring system, in particular to a monitoring system of a building. Thereby, not only the functions and positions of the door leaf may be monitored, but moreover, also the further energy recipients, such as acoustic and optical elements or display elements may be controlled. Advantageously, with the use of several energy recipients they may be employed as a guidance system for individuals, and in particular indicate and/or release escape routes in an emergency or danger situation. The transfer of the data may be realized via a transmission means, in particular a cable or likewise wire-less, wherein the data may be transferred for example via radio. Furthermore, the sensor unit may be a monitoring unit. In this case, an authorized passage through the door leaf or the distance of a user to the door leaf may be monitored. In addition, likewise a camera unit is conceivable, which monitors, respectively records the passages through the door leaf. In particular coupling a camera unit to a sensor unit is conceivable such that the sensor unit activates a recording function of the camera unit. Furthermore, sensor units for monitoring safety functions are conceivable such as for example a closing edge protection. Furthermore, an interlocking system is conceivable, which may transfer the door leaf into an interlocking condition and into an unlocking condition. In an interlocking condition, the door leaf is in the closing position, and cannot be transferred into the opening position.

Furthermore, the inventive object is achieved by a system for at least partially automatically actuating a door leaf, including: a guiding device in the shape of a guiding rail or a rotational bearing for a guiding reception of a casing element at a door casing, and a device, which may be embodied as described above. In this case, the same advantages are achieved, which are described above in conjunction with the inventive device, to which presently reference is fully made.

Furthermore, the inventive object is achieved by a method for mounting a device for at least partially automatically actuating a door leaf, which may be embodied as described above, including: at least one drive having a drive axis of rotation for driving the door leaf at least partially during a movement between an opening position and a closing position, a casing element having a casing axis of rotation for assisting a movement of the door leaf, lever kinematics having at least one lever arm for establishing an operative connection between the drive and the casing element, wherein the lever arm includes a connection section to the drive, which is supported to be rotationally movable around the drive axis of rotation, and wherein the lever kinematics includes at least one transmission means for transferring electric energy and/or data between at least one casing-sided energy source and a drive-sided energy recipient, wherein the method includes the following steps:

a) establishing a mechanical connection between the connection section and the drive, in order to mechanically attach the lever arm to the drive, b) establishing a mechanical connection between the transmission means and the connection section, in order to electrically connect the transmission means to the drive.

The inventive method allows for an inexpensive, simple and comfortable mounting of the inventive device. During mounting, the mechanic installer may initially establish in step a) a mechanical connection between the lever arm and the drive, and subsequently in step b) an electrical connection between the transmission means and the drive. For this purpose, the mechanic installer may intuitively work his/her way up from the bottom to the top through a functional compartment at the connection section of the lever arm. In this case, it is advantageous that in both steps the mechanic installer respectively establishes a mechanical connection, wherein in step b) the transmission means is automatically electrically connected to the drive by means of the connection to the connection section. Moreover, with the inventive method, the same advantages are achieved, which are described above in conjunction with the inventive device, to which presently reference is fully made.

BRIEF DESCRIPTION OF THE DRAWINGS

Hereinafter, further measures enhancing the disclosure will be illustrated in detail in the following in conjunction with the description of the preferred exemplary embodiments of the disclosure based on the Figures. In this context, the features mentioned in the claims and in the description, individually or in any arbitrary combination may be essential to the disclosure. In this case, it should be noted that the Figures do have a descriptive character only, and are not intended to delimit the disclosure in any way. In the drawings:

DETAILED DESCRIPTION OF THE DRAWINGS

Figure 1A:
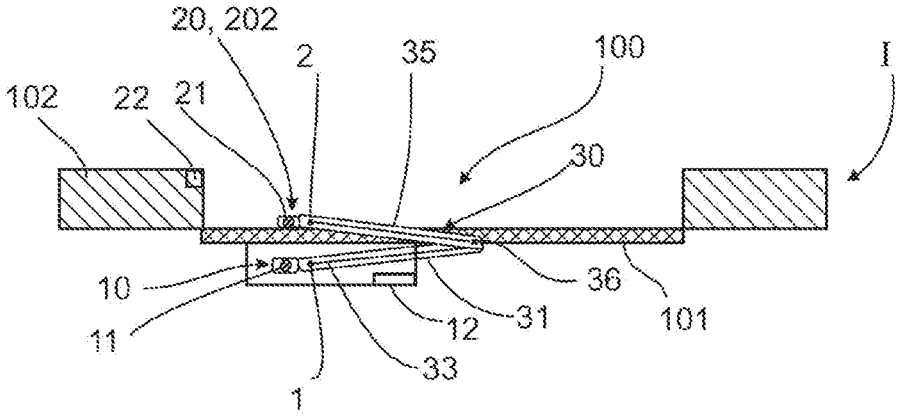
FIG. 1*a* shows a door leaf with an inventive device in a closing position in an exemplary embodiment.

Throughout the different Figures, same parts of the device 100 and of the system 110 are always identified by the same reference numerals, and therefore, normally they will be only described once.

Figure 1B:
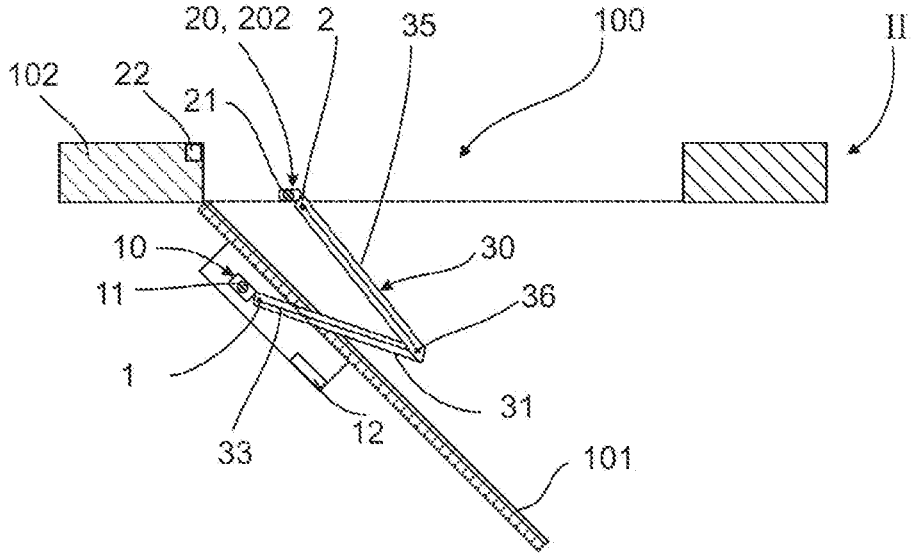
FIG. 1*b* shows a door leaf with an inventive device in an opening position in an exemplary embodiment.
Figure 2A:
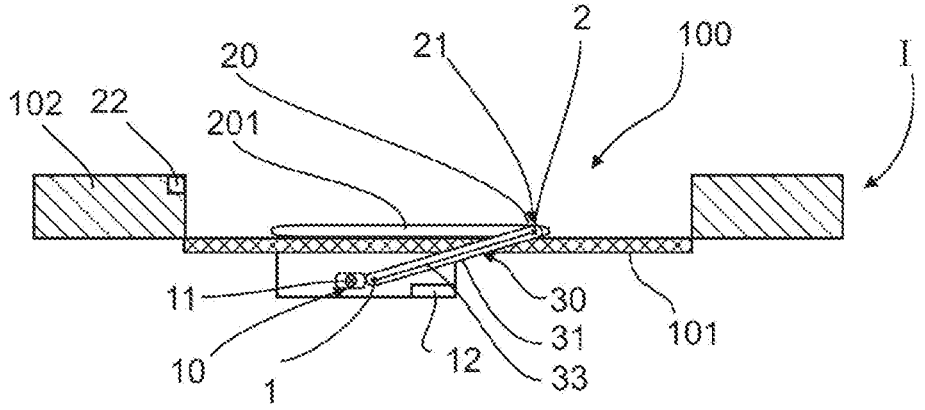
FIG. 2*a* shows a door leaf with an inventive device in a closing position in a further exemplary embodiment.
Figure 2B:
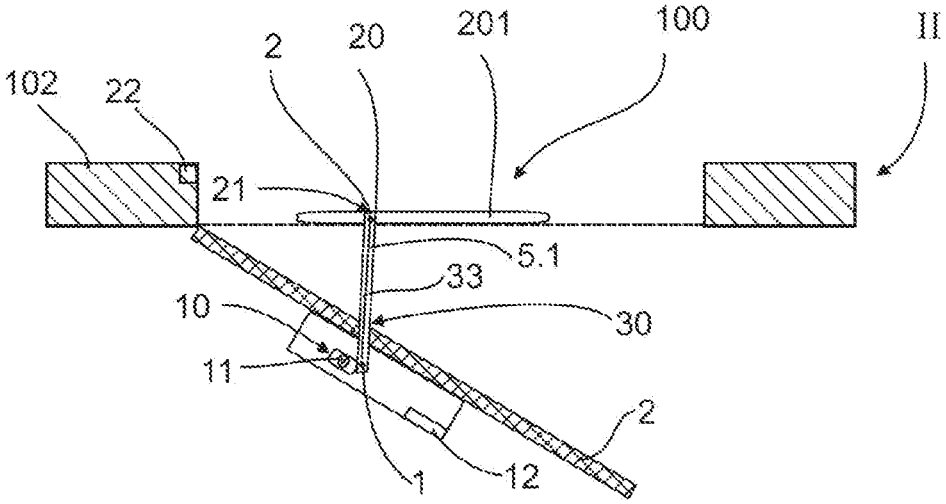
FIG. 2*b* shows a door leaf with an inventive device in an opening position in a further exemplary embodiment.

The FIGS. 1*a* and 2*a* show a door leaf 101 in a closing position I. The FIGS. 1*b* and 2*b* show the door leaf 101 in an opening position II. The door leaf 101 is equipped with an inventive device 100 for at least partially automatically actuating the door leaf 101.

The FIGS. 1*a* and 1*b* relate to a first exemplary embodiment of the device 100, and the FIGS. 2*a* and 2*b* relate to a second exemplary embodiment of the device 100.

In this case, the inventive device 100 includes a drive 10, which has a drive axis of rotation 11. Furthermore, the device 100 includes lever kinematics 30 with one lever arm 31 (refer to FIGS. 2*a* and 2*b*) or two lever arms 31, 35 (refer to FIGS. 1*a* and 1*b*).

From the side of the drive 10, the lever kinematics 30 is supported with a connection section 1 to be rotationally movable around the drive axis of rotation 11 of the drive 10. From the side of a door casing 102, the lever kinematics 30 is supported with a guiding section 2 to be rotationally movable around a casing axis of rotation 21. The casing axis of rotation 21 is disposed at a door casing-sided guiding device 200, which is able to guide the casing axis of rotation 21 linearly and rotatably in a guiding rail 201 (refer to FIGS. 2*a* and 2*b*), or only rotatably at a rotational bearing 202 (refer to FIGS. 1*a* and 1*b*). Furthermore, the lever kinematics 30 includes at least one transmission means 33 for transferring electrical energy and/or data between at least one casing-sided energy source 22 and a drive-sided energy recipient 12.

The drive 10 and the lever kinematics 30 allow for transferring the door leaf 101 from the closing position I (refer to FIGS. 1*a* and 2*a*) into the opening position II (refer to FIGS. 1*b* and 2*b*).

In the exemplary embodiment of the FIGS. 1*a* and 1*b*, the casing element 20 is shown as a stationary connecting element to the door casing 102, wherein said connecting element is supported at the rotational bearing 202 to be rotationally movable around the casing axis of rotation 21 as a stationary connection axis of rotation. Furthermore, the first lever arm 31 and the second lever arm 35 are supported to be rotationally movable with regard to each other around a joint 36. During a transfer of the door leaf 101 from the opening position II into the closing position I or vice versa, the two lever arms 31, 35 are rotated with regard to each other around the joint 36, so that said both lever arms 31, 35 in the opening position II of the door leaf 101 form a larger angle with each other than in the closing position I of the door leaf 101.

In the exemplary embodiment of the FIGS. 2*a* and 2*b*, the casing element 20 is shown as a sliding element, wherein the latter is supported to be rotationally movable around a casing axis of rotation 21 as a sliding axis of rotation. In this case, the casing element 20, in particular the sliding element, is employed as the transmission element to the guiding rail 201 at the door casing 102. Advantageously, the guiding rail 201 may be configured as a horizontal guide, and assist the movement of the door leaf 101. In this case, the lever kinematics 30 includes only one lever arm 31.

Figure 3A:
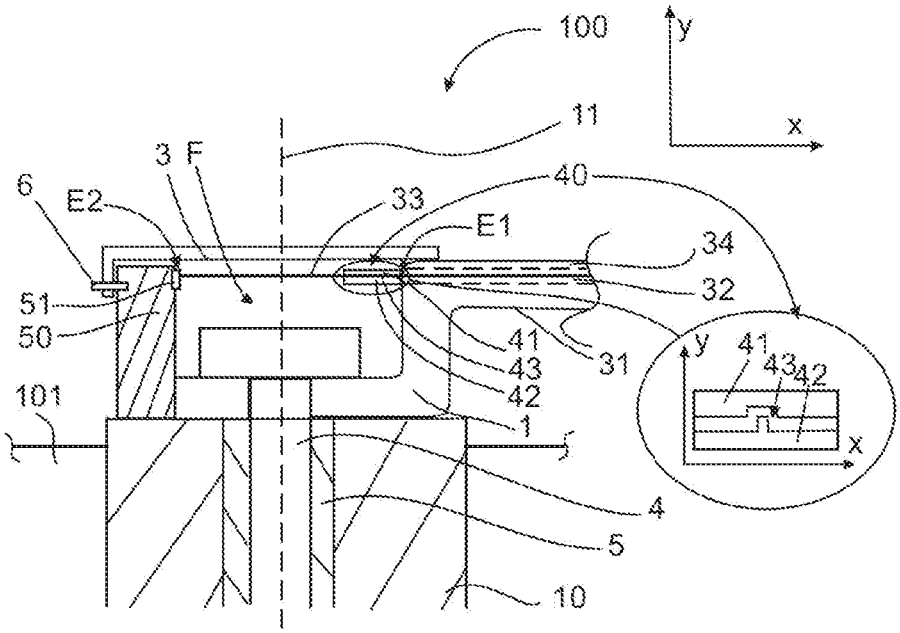
FIG. 3*a* shows a connection section of a lever arm having a cranked course in a potential exemplary embodiment.
Figure 3B:
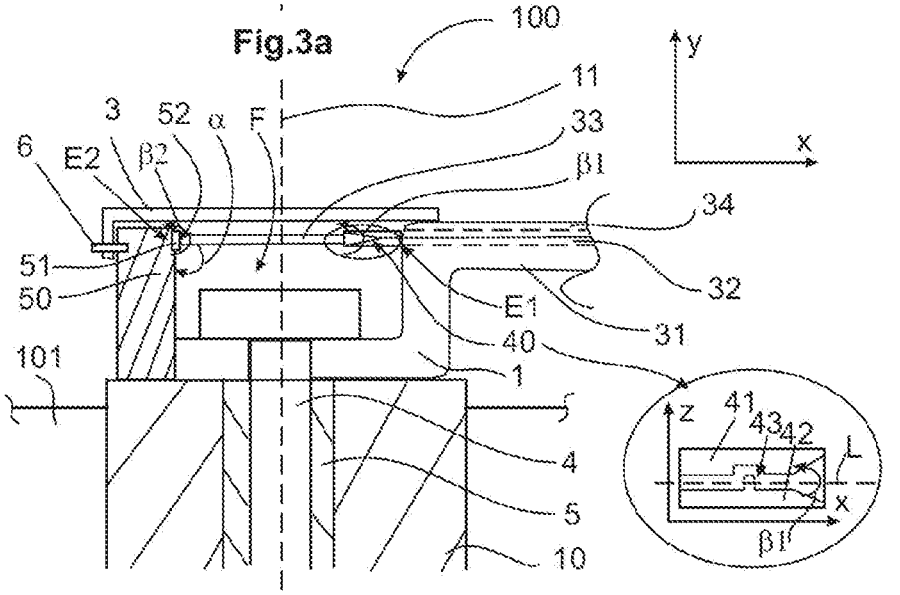
FIG. 3*b* shows a connection section of a lever arm having a cranked course in a further potential exemplary embodiment.
Figure 4A:
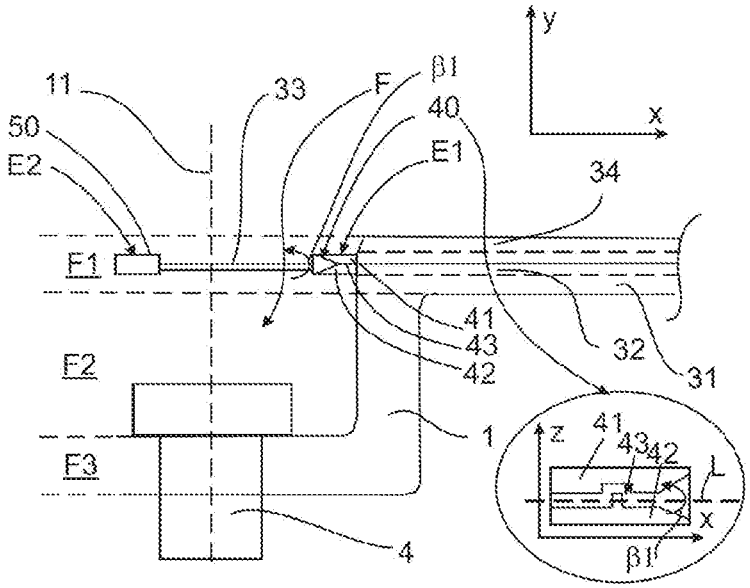
FIG. 4*a* shows a connection section of a lever arm having a cranked course in yet a further exemplary embodiment.
Figure 4B:
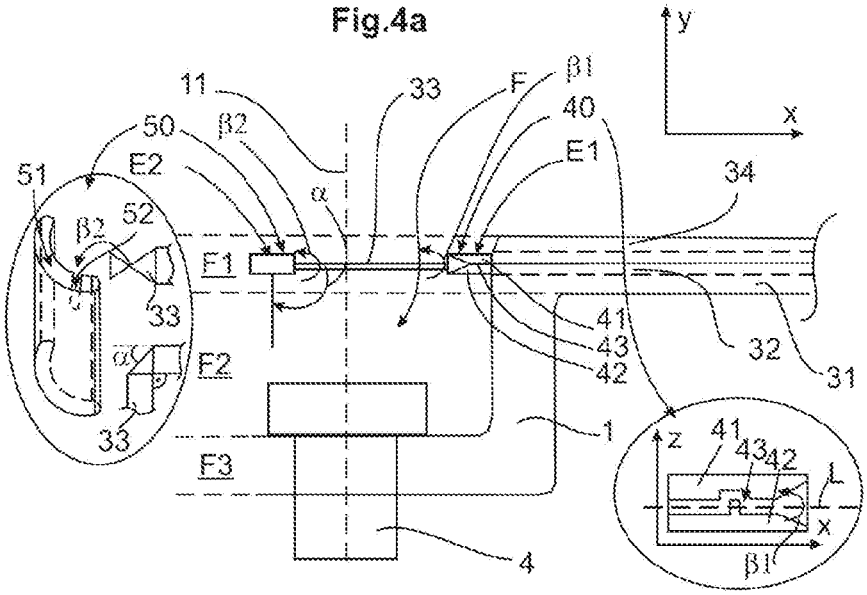
FIG. 4*b* shows a connection section of a lever arm having a cranked course in yet a further exemplary embodiment.

The FIGS. 3*a* and 3*b*, as well as the FIGS. 4*a* and 4*b* show the device 100 according to different further exemplary embodiments. However, the exemplary embodiments have in common that the connection section 1 has a cranked course, wherein a multi-layered functional compartment F for mechanically connecting the lever arm 31 and for electrically connecting the transmission means 33 to the drive 10 is configured along the cranked course of the connection section 1.

The transmission means 33 is employed for transferring electrical energy and/or data between the casing-sided energy source 22 and the drive-sided energy recipient 12 at the door leaf 101. The data to be transferred may serve for example for detecting the position of the door leaf 101 or for displaying the condition of the door leaf 101. The energy recipient 12 may be embodied for visualizing the data with a display device. The electrical energy to be transferred may be employed for transferring the door leaf 101 from the opening position II into the closing position I. In this case, the closing force required for closing the door leaf 101 may be reduced, increased or adjusted according to a predetermined pattern course by the drive 10. Moreover, the door leaf 101 may be retained in at least one position, for example the opening position II.

At least section-wise the transmission means 33 may be configured as a flat cable, flat ribbon cable, a flexible printed circuit board or as a round cable. Furthermore, the lever arm 31 may include a guiding groove 32 for the transmission means 33, which groove in the FIGS. 3*a* to 4*b* is diagrammatically illustrated by dashed lines. Thus, the transmission means 33 may be laid through the lever arm 31 in a countersunk and protected manner. Moreover, the lever arm 31 may include a groove covering 34 for the guiding groove 32, and thus for the transmission means 33. In this case, the groove covering 34 assists in protecting the transmission means 33 against manipulation and/or environmental influences.

According to the disclosure, a multi-layered functional compartment F having multiple layers F1, F2, F3 is formed by the cranked course of the connection section 1, which are identified in the FIGS. 4*a* and 4*b*. Thereby, the functional compartment F may be employed for a plurality of different application possibilities.

On the one hand, with the connection section 1, at least one mounting layer F3 is formed in the functional compartment F, in which the connection section 1 may be mounted with a lower terminal part to be rotationally movable around the drive axis of rotation 11 by means of an attachment means 4, for example in the shape of a screw. In this case, the attachment means 4 may be connected torque-proof to a rotatable bolt 5, in order to allow for a rotation of the lever 31 around the drive axis of rotation 11.

On the other hand, in a further reception layer F2, the functional compartment F is employed as an additional compartment, in order to be able to readily place the attachment means 4 when mounting of the device 100 within the functional compartment F.

Furthermore, in a guiding layer F1, the functional compartment F is used as a cable compartment for the passage of the transmission means 33. Moreover, the functional compartment F is configured such that a plug-in unit 50 may be disposed in the guiding layer F1, in order to electrically connect the transmission means 33 to the drive 10 by simply plugging it in into the plug-in unit 50. In the following different configurations of the plug-in unit 50 will be explained in detail. Moreover, the functional compartment F, in particular the guiding layer F1 may be embodied with a traction relief unit 40 for the transmission means 33. Likewise in the following, different configurations of the traction relief unit 40 will be explained in detail.

Advantageously, the functional compartment F, at least in the guiding layer F1, may be employed for twisting and/or for deflecting the transmission means 33, in order to provide for an improved length and/or rotation compensation for the transmission means 33 within the functional compartment F.

As shown in the FIGS. 3*a* and 3*b*, as well as in the FIGS. 4*a* and 4*b*, the functional compartment F, in particular in the guiding layer F1, includes an entry area E1 into the functional compartment F, and an exit area E2 from the functional compartment F for the transmission means 33, which are embodied such that the transmission means 33 is guided transversely to, respectively through the drive axis of rotation 11 through the functional compartment F. The traction relief unit 40 may be disposed at the entry area E1, and the plug-in unit 50 may be disposed at the exit area E2. A vertex is formed at the transmission means 33 by means of the passage of the transmission means 33 through the drive axis of rotation 11. Thereby, the advantage may be achieved that a length compensation of the transmission means 33 may be obtained during a relative rotation between the lever kinematics 30 and the drive 10. As the transmission means 33 extends through the drive axis of rotation 11, the length thereof, which is accommodated in the functional compartment F, corresponds to a diameter of the functional compartment F, and will not be modified during the relative rotation of the lever kinematics 30 and the drive 10.

As shown in the FIGS. 3*a* and 3*b*, the connection section 1 includes a cover element 3, in order to at least partially delimit, mechanically protect or seal the functional compartment F. For this purpose, a closing element 6 and/or a seal 6 or a combined closing and sealing element may be employed. Thereby, the inside of the device 100 with sensitive electrical connections, potentially sensor technology and mechanical attachment means 4 may be closed off and/or sealed.

In the different exemplary embodiments in FIG. 3*a* (without torsion), and in the FIGS. 3*b* as well as 4*a* and 4*b* (with torsion), the traction relief unit 40 is diagrammatically illustrated. Basically, the traction relief unit 40 is embodied with a first connecting element 41 and a second connecting element 42, in order to positively and/or non-positively immobilize the transmission means 33 between the first connecting element 41 and the second connecting element 42. In this case, it should be noted that a non-positive connection is not established by pressing onto the transmission means 33, but by means of a light, preferably repeated bending of the transmission means 33, whereby a kink-free friction connection is realized. The traction relief unit 40 serves for inhibiting the transmission of a mechanical traction at the electrical connection locations to the drive 10, and for preventing a release of the transmission means 33 from the drive 10. In particular in one exemplary embodiment of the guiding device 200 according to the FIGS. 2*a* and 2*b* in the shape of a guiding rail 201, the transmission means 33 may be guided under tension at the casing element 20. However, also in a pure rotational bearing 202 of the casing element 20 according to the FIGS. 1*a* and 1*b*, a tension may be present in the transmission means 33. Said tension may be eliminated from the transmission means 33 at the drive side by means of the traction relief unit 40.

For this purpose, the traction relief unit 40 may include a labyrinth guide 43 between the first connecting element 41 and the second connecting element 42, as shown in the FIGS. 3*a* to 4*b* in an enlarged view of the traction relief unit 40. By means of the labyrinth guide 43, the tensile stress from the transmission means 33 may be deviated to the traction relief unit 40. The labyrinth guide 43 may deflect the traction force several times, and enhance the distribution of the traction force at the traction relief unit 40. However, the labyrinth guide 43 allows for retaining the transmission means 33 in a kink-free manner in that a certain friction connection is established.

Figure 5A:
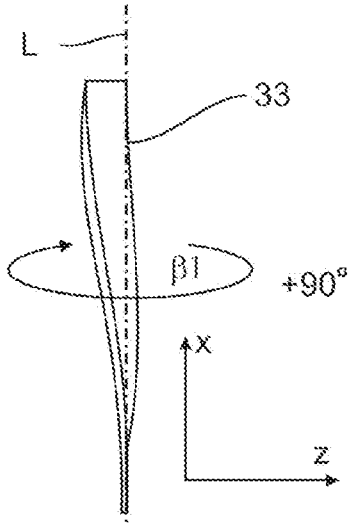
FIG. 5*a* shows a first torsion of a transmission element.

As shown in the FIGS. 3*b*, 4*a*, and 4*b*, the labyrinth guide 43 may be configured such that the transmission means 33 is passed in a twisted manner around a first angle of torsion β1 through the labyrinth guide 43. Thereby, the transmission means 33 may be rotated around the longitudinal axis L thereof around the first angle of torsion β1, as shown in the enlarged view of the traction relief unit in the FIGS. 3*b* to 4*b*, and in the diagrammatical view of the transmission means 33 in FIG. 5*a*. Such a twisted immobilization of the transmission means 33 at the traction relief unit 40 assists in achieving a rotation compensation at the transmission means 33, if the lever kinematics 30 and the drive axis of rotation 11 rotate in relation to each other. A rotation compensation by means of a torsion is in particular advantageous with a flat ribbon cable as a transmission means 33.

As shown in FIG. 4*a*, the transmission means 33 may include only one torsion around a first angle of torsion β1, preferably of 90°, at an entry area E1 into the functional compartment F, which for example may be realized by means of the traction relief unit 40.

Figure 5B:
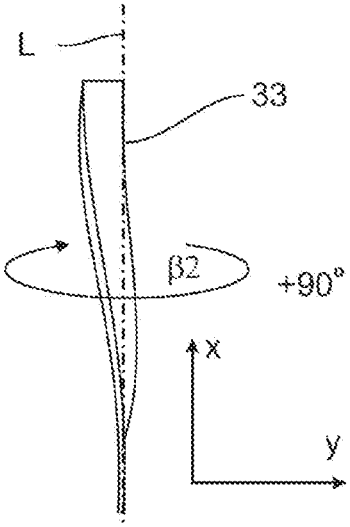
FIG. 5*b* shows a second torsion of a transmission element.

As shown in the FIGS. 3*b* and 4*b*, the transmission means 33 may include a first torsion around a first angle of torsion β1, preferably of 90°, at the entry area E1 into the functional compartment F, and a second torsion around a second angle of torsion β2, preferably of 90°, at the exit area E2 from the functional compartment F. Advantageously, tensions may be intercepted and equalized by the first torsion, which tensions develop in the axis of rotation x, z of the lever arm 31, as indicated in the enlarged view of the traction relief unit 40 in the FIGS. 3*b* and 4*b* or the FIG. 5*a*. Moreover, the second torsion is able to intercept and equalize tensions, which develop in the plane x, y, which is determined by the longitudinal axis L of the lever arm and the drive axis of rotation 11, as indicated in the FIG. 5*b*. Thereby, in a simple and advantageous manner, a reliable three-dimensional rotation compensation may be established at the transmission means 33 having even the shape of a flat ribbon cable.

Furthermore, as shown in the FIGS. 3*b* and 4*b*, the transmission means 33 may include at least one deflection having a deflection angle α, preferably of 45°, at an exit area E2 from the functional compartment F, in order to deflect the transmission means 33 from an orientation transversely to the drive axis of rotation 11 of the drive 10 into an orientation parallel to the drive axis of rotation 11. The deflection of the transmission means 33 may be understood as a kinking of the transmission means 33 under a change of direction of 90°. By deflecting the transmission means 33 into the direction parallel to the drive axis of rotation 11, the transmission means 33 may be guided underneath the connection section 1 directly to the drive 10.

Furthermore, as shown in the FIGS. 3*a* and 3*b*, as well as 4*a* and 4*b*, the connection section 1 at the exit area E2 from the functional compartment F may include a plug-in unit 50 for the transmission means 33, in order to electrically connect the transmission means 33 to the drive 10. Thus, a simple contacting of the transmission means 33 to the drive 10 may be realized.

As shown in the FIGS. 3*b* and 4*b*, the plug-in unit 50 may be embodied such that the transmission means 33 is guided through the plug-in unit 50 deflected around a deflection angle $\alpha$, preferably of 45°, and/or twisted around a second angle of torsion $\beta$2. Thereby, at the exit area E2 from the functional compartment F, the transmission means 33 may be accommodated by the plug-in unit 50, preferably with a rotation compensation and/or traction relief.

In the exemplary embodiment of the FIGS. 3*b* and 4*b*, the plug-in unit 50 may include a plug-in guide 51, which is configured at least partially cylinder-envelope shaped with regard to the drive axis of rotation 11 of the drive 10, in order to deflect the transmission means 33 from an orientation transversely to the drive axis of rotation 11 into an orientation parallel to the drive axis of rotation 11, wherein in addition the plug-in guide 51 includes a slot 52, which is oriented parallel to the drive axis of rotation 11 of the drive 10, in order to introduce the transmission means 33 into the plug-in guide 51 in a twisted manner.

On the left side in FIG. 4*b*, the plug-in unit 50 is illustrated enlarged, in order to illustrate the plug-in guide 51, configured cylinder-envelope shaped, and the slot 52 at the entry into the plug-in guide 51, which slot extends parallel to the drive axis of rotation 11. Thus, a flat ribbon cable as the transmission means 33 may be accommodated kink-free and break-free in the plug-in unit 50, wherein the flat ribbon cable may be accommodated in a deflected manner in the cylinder-envelope shaped configured plug-in guide 51 of the plug-in unit 50 and/or accommodated in a twisted manner by means of the slot 52, which is oriented parallel to the drive axis of rotation 11. In other words, the cylinder-envelope shaped configured plug-in guide 51 with a slot 52 extending parallel to the drive axis of rotation 11 may guide the flat ribbon cable to the drive 10 with traction relief and with a rotation compensation.

Figure 6:
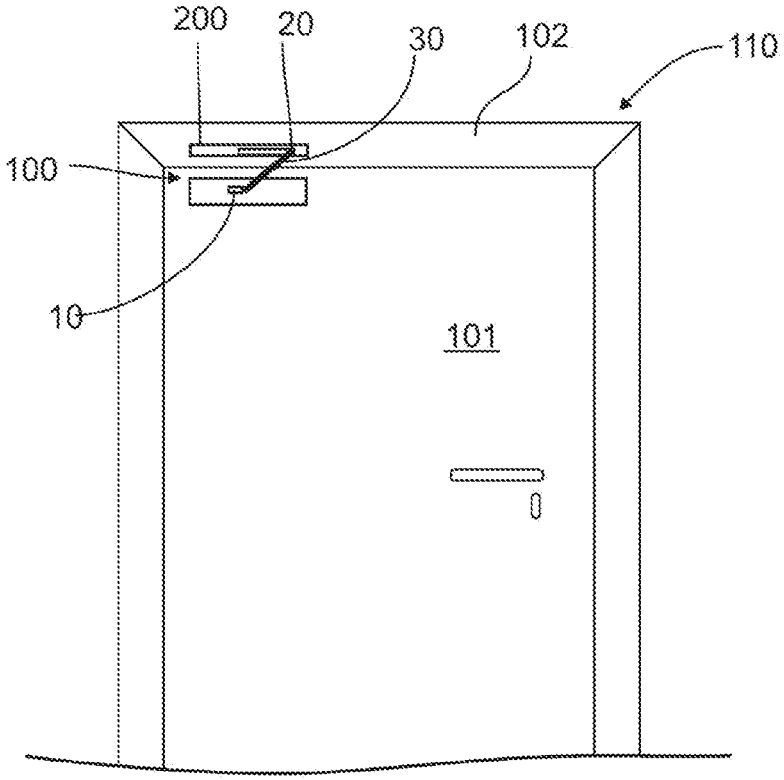
FIG. 6 shows a diagrammatic illustration of an inventive system.

Finally, FIG. 6 shows an inventive system 110 for at least partially automatically actuating a door leaf 101, including: a guiding device 200 in the shape of a guiding rail 201 or a rotational bearing 202 for a guiding reception of a casing element 20 at a door casing 102, and a device 100, which may be embodied as described above.

The inventive device 100 and the inventive system 110 include many advantages, such as simple structure with few structural components, an inexpensive, simple and comfortable mounting, an expanded and enhanced functionality, and a high-quality appearance of the device, as well as a high protection against manipulation.

The preceding description of the FIGS. 1 to 6 describes the present disclosure exclusively on the basis of examples. Obviously, individual features of the embodiments, as long as they are technically reasonable, may be freely combined with each other without departing from the scope of the present disclosure.

The invention claimed is:

1. A device for at least partially automatically actuating a door leaf, the device comprising:

a drive with a drive axis of rotation for driving the door leaf at least partially during a movement between an opening position and a closing position, a casing element with a casing axis of rotation for assisting a movement of the door leaf, lever kinematics with at least one lever arm for establishing an operative connection between the drive and the casing element, wherein the lever arm includes a drive-sided connection section, which is supported to be rotationally movable around the drive axis of rotation, and wherein the lever kinematics includes at least one transmission means for transferring electrical energy and/or data between at least one casing-sided energy source and a drive-sided energy recipient, wherein that the connection section has a course, wherein a multi-layered functional compartment for mechanically connecting the lever arm and for electrically connecting at least one transfer means to the drive is configured along the course of the connection section, wherein the connection section at an entry area into the functional compartment includes a traction unit with a first connecting element and a second connecting element configured to positively and/or non-positively immobilize the transmission means between the first connecting element and the second connecting element, wherein the traction unit includes a guide between the first connecting element and the second connecting element, and/or in that the guide is configured such that the transmission means is passed in a twisted manner around a first angle of torsion through the guide.

2. The device according to claim 1, wherein the functional compartment includes at least one of the following layers, namely:

a guiding layer for guiding the transmission means from the lever arm to the drive, a reception layer for the at least partial reception of a mechanical attachment means, in order to attach the lever arm rotationally movable at the drive, a mounting layer for establishing an interface between the lever arm and the drive.

3. The device according to claim 2, wherein the functional compartment, in particular in the guiding layer, includes an entry area into the functional compartment, and an exit area from the functional compartment for the transmission means, which are embodied such that the transmission means is guided transversely to the drive axis of rotation through the functional compartment.

4. The device according to claim 1, wherein the connection section includes a cover element configured to at least delimit, mechanically protect or seal the functional compartment.

5. The device according to claim 1, wherein the transmission means includes at least one first torsion around a first angle of torsion at an entry area into the functional compartment, or a second torsion around a second angle of torsion at an exit area from the functional compartment.

6. The device according to claim 1, wherein the transmission means includes at least one deflection having a deflection angle at an exit area from the functional compartment, in order to deflect the transmission means from an orientation transversely to the drive axis of rotation of the drive into an orientation parallel to the drive axis of rotation.

7. The device according to claim 1, wherein the connection section at an exit area from the functional compartment includes a plug-in unit for the transmission means, in order to electrically connect the transmission means to the drive.

8. The device according to claim 7, wherein the plug-in unit is embodied such that the transmission means is guided through the plug-in unit at least deflected around a deflection angle or twisted around a second angle of torsion, and/or in that the plug-in unit includes at least one plug-in guide configured at least partially cylinder shaped to the drive axis of rotation of the drive, in order to deflect the transmission means from an orientation transversely to the drive axis of rotation into an orientation parallel to the drive axis of rotation, wherein the plug-in guide includes a slot, which is oriented parallel to the drive axis of rotation of the drive, in order to introduce the transmission means in a twisted manner into the plug-in guide.

9. The device according to claim 1, wherein that the transmission means is configured at least section-wise as a flat cable, flat ribbon cable or as a flexible printed circuit board, and/or the transmission means is configured at least section-wise as a round cable.

10. The device according to claim 1, wherein the lever arm includes a guiding groove for the transmission means, and/or in that the lever arm includes a groove covering for the transmission means, in particular for the guiding groove.

11. The device according to claim 1, wherein the energy recipient is at least one of the following:

electrical motor,
hydraulic actor,
pneumatic actor,
cylinder,
electro-chemical actor,
electro-mechanical actor,
piezoelectric element,
magnetic element,
shape memory element,
optical element,
acoustic element,
display element,
control unit,
transmitting/receiving unit,
sensor unit,
interlocking unit,
interface.

12. A system for at least partially automatically actuating a door leaf, the system including:

a guiding device in the shape of a guiding rail or of a rotational bearing for a guiding reception of the casing element at a door casing, and and a device according to claim 1.

13. A method for mounting a device for at least partially automatically actuating a door leaf comprising:

at least one drive with a drive axis of rotation for driving the door leaf at least partially during a movement between an opening position and a closing position, a casing element with a casing axis of rotation for assisting a movement of the door leaf, lever kinematics with at least one lever arm for establishing an operative connection between the drive and the casing element, wherein the lever arm includes a drive-sided connection section, which is supported to be rotationally movable around the drive axis of rotation, and wherein the lever kinematics includes at least one transmission means for transferring electrical energy and/or data between at least one casing-sided energy source and a drive-sided energy recipient, wherein the connection section at an entry area into the functional compartment includes a traction unit with a first connecting element and a second connecting element configured to positively and/or non-positively immobilize the transmission means between the first connecting element and the second connecting element, wherein the traction unit includes a guide between the first connecting element and the second connecting element, and/or in that the guide is configured such that the transmission means is passed in a twisted manner around a first angle of torsion through the guide, wherein the method includes the following steps:

a) establishing a mechanical connection between the connection section and the drive, in order to mechanically attach the lever arm at the drive, and b) establishing a mechanical connection between the transmission means and the connection section, in order to electrically connect the transmission means to the drive.

* * * * *